US006502430B1

(12) United States Patent
Myers

(10) Patent No.: US 6,502,430 B1
(45) Date of Patent: Jan. 7, 2003

(54) CONTINUOUSLY KNIT HOSIERY AND UNDERWEAR GARMENTS HAVING VARIABLY GRADUATED DIAMETERS

(75) Inventor: Jonathan Myers, Winston-Salem, NC (US)

(73) Assignee: Sara Lee Corporation, Winston-Salem, NC (US)

( * ) Notice: Subject to any disclaimer, the term of this patent is extended or adjusted under 35 U.S.C. 154(b) by 0 days.

(21) Appl. No.: 10/058,818

(22) Filed: Jan. 28, 2002

Related U.S. Application Data

(63) Continuation-in-part of application No. 09/918,978, filed on Jul. 31, 2001, now Pat. No. 6,341,506, which is a continuation-in-part of application No. 09/195,017, filed on Nov. 18, 1998, now abandoned, which is a continuation-in-part of application No. 08/909,245, filed on Aug. 11, 1997, now abandoned.

(51) Int. Cl.[7] ..... A41B 11/00
(52) U.S. Cl. ..... 66/189; 66/178 R

(58) Field of Search ..... 66/178 R, 179, 66/180, 181, 182, 183, 178 A, 189; 2/239, 240, 241, 242

(56) References Cited

U.S. PATENT DOCUMENTS 6,341,506 B1 * 1/2002 Myers ..... 66/178 R

* cited by examiner

*Primary Examiner*—Danny Worrell
(74) *Attorney, Agent, or Firm*—Kilpatrick Stockton LLP

(57) ABSTRACT

Continuously knit hosiery and underwear garments provide variably graduated diameters. In a blank having panty, thigh, knee, ankle, and foot portions are separated from each other by outwardly and inwardly graduated diameter portions while maintaining a constant number of wales throughout. The blank is thereby configured to conform to the natural shape of a female lower torso and leg with gradually increasing and decreasing diameters to avoid abrupt diameter changes and maintain the integrity of the fabric's appearance in the blank and garment.

46 Claims, 3 Drawing Sheets

CONTINUOUSLY KNIT HOSIERY AND UNDERWEAR GARMENTS HAVING VARIABLY GRADUATED DIAMETERS

CROSS-REFERENCE TO RELATED APPLICATIONS

This is a continuation-in-part application of, and claims the benefit of priority to, U.S. Pat. No. 6,341,506, issued Jan. 29, 2002, from U.S. application Ser. No. 09/918,978, filed Jul. 31, 2001, which is a continuation-in-part application of U.S. application Ser. No. 09/195,017, filed Nov. 18, 1998, now abandoned, which is a continuation-in-part application of U.S. application Ser. No. 08/909,245 filed Aug. 11, 1997, now abandoned, each of which is incorporated herein by reference in its entirety.

FIELD OF THE INVENTION

The invention relates to a hosiery and underwear garments, and more particularly to continuously knit hosiery and underwear garments having variably graduated diameter portions configuring the garments to conform to the natural shape of a wearer's lower torso and/or leg.

BACKGROUND

Pantyhose and hosiery manufacturers have long searched for a construction that would enable leg covering hosiery garments to more precisely conform to the shape of a wearer's lower torso and/or leg, thus enhancing fit characteristics and garment appearance. In conventional hosiery manufacturing, some shaping has been possible on fixed needle circular knit hosiery machines through the use of stitches that are gradually reduced in size along the length of a blank as the blank is knit. For example, the top of a blank, which conforms to the waist of the pantyhose formed from two such blanks, starts at a given maximum diameter opening and then is gradually reduced in diameter along the length of the garment as the garment is continuously knit toward the toe. Such a blank having decreasing diameter in one direction provides a more precise fit from the larger upper portion of the leg to the smaller lower portion of the leg to the yet smaller foot. In such conventional approaches to reducing diameter of a pantyhose blank, graduated stitches are those stitches that have been reduced in stitch length, thus removing yarn from each course that utilizes the smaller stitches. This technique, in conjunction with the use of stretch yarn, has been somewhat effective to provide a garment with good fit characteristics through the tapering process. However, there is still a need for a technique to fully configure such a garment to both decrease and selectively increase a blank and garment made therefrom comprising variable diameters that follow the general shape of a female lower torso and leg both inwardly and outwardly.

SUMMARY OF THE INVENTION

The present invention provides continuously knit hosiery and underwear garments having variably graduated diameters. Embodiments of the present invention comprise a circularly knit, constant wale tubular hosiery blank having panty, thigh, knee, ankle, and foot portions that are selectively separated by increasing and decreasing diameter graduation portions to configure the blank to conform to the natural shape of a female lower torso and/or leg. In embodiments of the present invention, a blank for a pantyhose garment that utilizes two such blanks joined together is knit starting at the welt or waist portion and then extending downwardly through the upper panty portion, the middle panty portion, the lower panty portion, the thigh portion, the knee portion, the ankle portion, and finishing at the foot portion with the diameter of the tubular blank decreasing and /or increasing by the use of graduated stitches throughout the length. In the present invention, the blank is started at an upper panty portion on all of the needles of the machine, thus having a fixed number of wales and a constant diameter. The blank then extends to a panty graduation portion having an increasing diameter, then to a lower panty/upper boot portion of constant diameter, and thereafter to the thigh graduation portion having a decreasing diameter. The knee is formed with a constant diameter, followed with a lower leg graduation portion of decreasing diameter connecting the knee portion to an ankle portion of constant diameter. A final instep graduation portion of increasing diameter extends to a formed foot portion of constant diameter. Thus, the blank comprises selectively positioned areas of at least two graduation portions of increasing diameter and two graduation portions of decreasing diameter. The number of needles and resulting wales remains the same throughout the blank.

In embodiments of the present invention, the panty graduation portion of increasing diameter provides additional yarn and fabric in the lower panty portion and crotch area to reduce stress on the yarn and fabric in those locations. Yarn and fabric stress in the lower panty portion and crotch area occurs because a U-shaped seam is used to join the blanks together, either with or without a gusset, which reduces the amount of fabric in each of the blanks in the areas they are sewn together. In embodiments, after sufficient courses are knit in a tubular hosiery garment blank to establish a pre-determined cross-stretch and initial panty diameter, the panty portion is graduated with an outwardly increasing diameter by increasing stitch length. In embodiments in which the panty diameter is graduated outwardly, increasing stitch lengths replaces an amount of fabric lost to a U-shaped seam used to join blanks together. In such embodiments, an increasingly outwardly graduated panty diameter reduces the stress to which the yarn and fabric is subjected. As a result, replaced fabric in the panty and crotch area enhances the ability of the garment to fit the contour of the female anatomy in those areas and thus be more comfortable than conventional pantyhose garments.

In other embodiments of the present invention, a blank for a pantyhose garment that utilizes two blanks joined together is knit starting at the toe portion and then extends upwardly through the foot portion, the ankle portion, the knee portion, the thigh portion, the lower panty portion, the upper panty portion, and finally the welt or waist portion. In such an embodiment, the diameter of the tubular blank is decreased and/or increased by the use of graduated stitches throughout the length of the garment.

In other embodiments, a pantyhose garment can include a gusset of appropriate size along the juncture line formed when the tubular blanks are slit and sewn together along their slit edges. In such embodiments, a gusset provides additional fit characteristics to the pantyhose garment.

Features of continuously knit hosiery and underwear garments having variably graduated diameters of the present invention may be accomplished singularly, or in combination, in one or more of the embodiments of the present invention. As will be appreciated by those of ordinary skill in the art, the present invention has wide utility in a number of applications as illustrated by the variety of features and advantages discussed below.

Continuously knit hosiery and underwear garments having variably graduated diameters of the present invention provide numerous advantages over prior pantyhose blanks and garments. For example, the present invention advantageously provides superior fit and appearance characteristics brought about by the selective use of decreasing and increasing graduation stitches during the knitting process.

Another advantage is that the present invention provides a pantyhose garment utilizing two identically formed circularly knit tubular blanks which, when joined, comprise a panty portion and individual leg and foot portions, each portion having superior fit and appearance characteristics due to the selective use of decreasing and increasing graduation stitches in each portion.

As will be realized by those of skill in the art, many different embodiments of continuously knit hosiery and underwear garments having variably graduated diameters according to the present invention are possible. It is to be understood that the invention is not limited in its application to the details of construction and to the arrangement of the components set forth in the following description or illustrated in the drawings. The phraseology and terminology herein are for the purpose of description and should not be regarded as limiting in any respect. Those skilled in the art will appreciate the concept upon which this disclosure is based and that it may readily be utilized as a basis for designing other structures, methods, and systems for carrying out the present invention. Additional uses, objects, advantages, and novel features of the invention are set forth in the detailed description that follows and will become more apparent to those skilled in the art upon examination of the following or by practice of the invention.

DETAILED DESCRIPTION

Embodiments of the present invention provide a continuously knit tubular hosiery blank having panty, thigh, knee, ankle, and foot portions that are selectively separated by increasing and decreasing diameters of the portions to configure the blank to conform to the natural shape of a female lower torso and/or leg. FIGS. 1–5 show various aspects of such embodiments.

Figure 1:
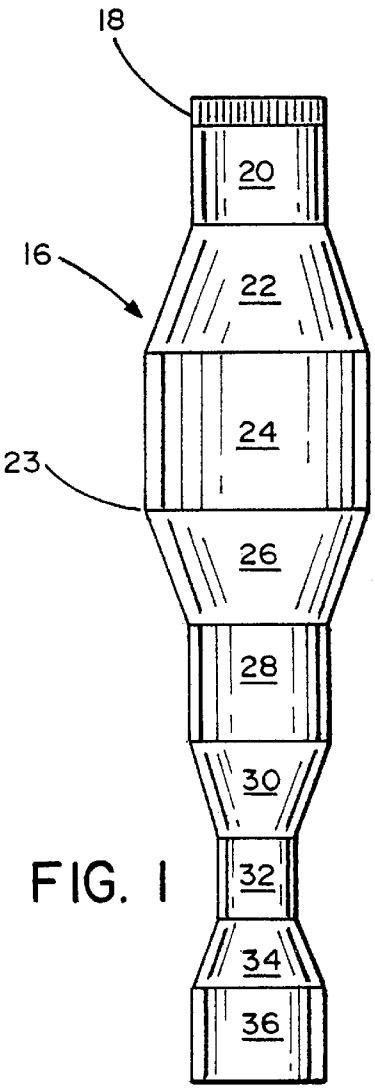
FIG. 1 is a frontal view of a hosiery blank comprising the invention, illustrating in emphasized fashion the selective inclusion of a plurality of graduation portions of increasing and decreasing diameter separating the panty, boot, knee, ankle, and foot portions.

Prior to describing the present invention in detail, reference is made to the blank 16 shown in FIG. 1 and to the application of conventional pantyhose manufacturing practices. Blank 16 is one blank which is to be paired with another blank of similar construction, each of which is slit and seamed along paired slit edges and formed into a pantyhose garment. The blank may include a double welt tubular portion of, for example, 144 courses, which may comprise stretch nylon or combinations of stretch nylon, elastic yarn s, and other combination yarns. The welt portion is followed by a second tubular portion of the same diameter having approximately 700 to 800 courses. The term "diameter" is used to reflect the distance between one edge of a flattened uncut tubular blank to the other edge. While this is standard terminology in the industry and is used as such herein, "diameter" also refers herein to the diameter of a garment when two blanks are joined together, for example in the garment panty portion. The measured diameter, or "cross-stretch," of a typical pantyhose garment when measured as a "stretched diameter" is about 13 inches. While stitch type may vary, a plain jersey stitch is typically used. At the end of the second tubular portion, the garment is narrowed in diameter by the utilization of graduated stitches so that the length of the stitch utilized in each successive course is reduced. The graduated stitches continue or selectively stop and recommence at locations down the leg until the smallest diameter area is reached at the ankle and foot portion. The same number of needle-formed wales are used throughout.

Figure 2:
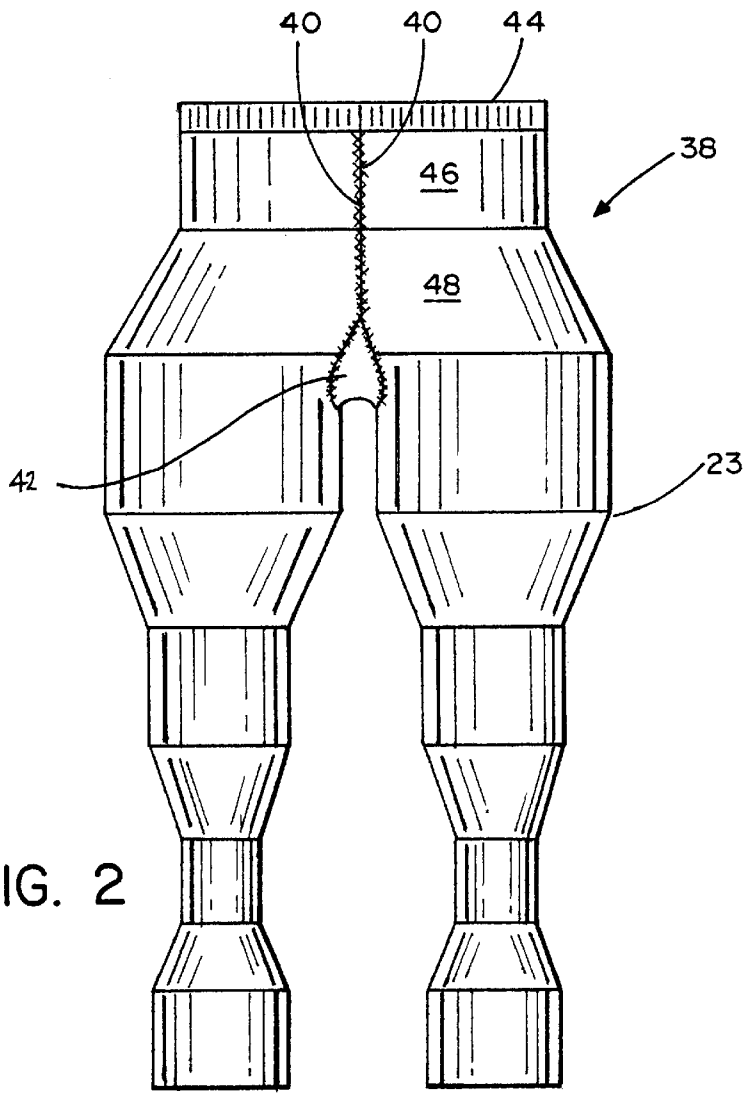
FIG. 2 is a frontal view of a pantyhose garment comprising the present invention formed by joining two hosiery blanks like that shown in FIG. 1.
Figure 3:
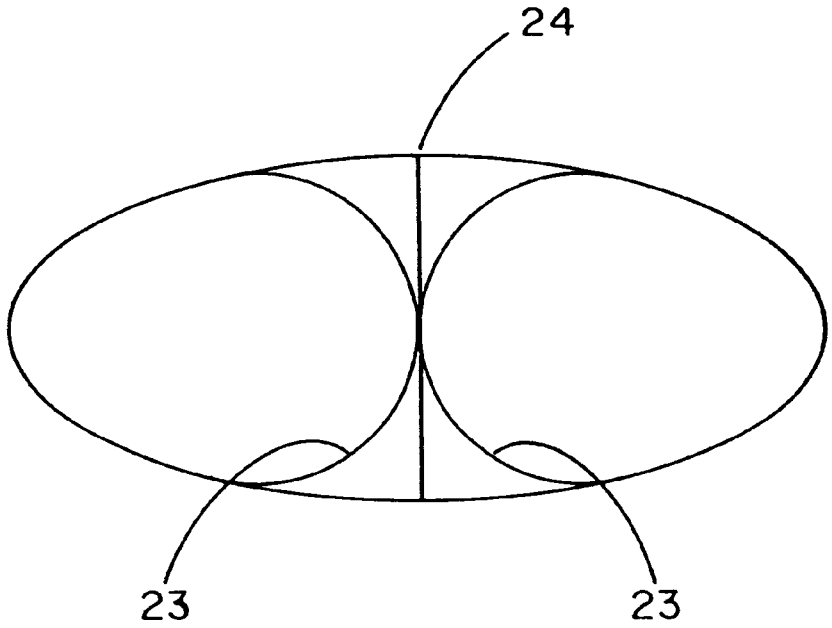
FIG. 3 is a plan schematic view of the pantyhose garment shown in FIG. 2.

Referring to FIGS. 1 and 2, during conventional construction, yarn and fabric tension and stress occur in lower panty portion 24 where two blanks 16 are paired together, because a greater amount of fabric is required to encircle the two upper thigh portions 23 of the legs than is required to encircle the hip portion 48 just before the formation of the legs. This has long been a concern for pantyhose manufacturers since the stress and tension in the panty portion and crotch area occurs inherently from the manufacturing process wherein a U-shaped seam typically joins paired slit edges of the blanks. Increased stress and tension at this location causes discomfort to the wearer and early failure of the garment. Such a problem has prevailed since the beginning of widespread use of pantyhose garments in the 1960's.

The present invention represents a significant improvement over conventional practice and results in a garment having superior fit, comfort, and appearance characteristics over those produced by conventional pantyhose manufacturing. In the embodiment shown in FIG. 1, the blank 16 (to be paired with an identical blank 16) is commenced with a double welt tubular portion 18 followed by an upper panty portion 20 having a substantially constant diameter $d_1$. Upper panty portion 20 is followed by a graduation portion 22 of increasing diameter $d_2$ until the lower panty/upper boot portion 24 having a constant diameter $d_3$ is commenced.

The increased diameter of lower panty portion 24 formed by the pairing of the two blanks 16 like that described provides additional yarn and fabric at a critical location in the panty portion near the crotch of the garment where the two leg portions begin. A greater amount of fabric is required to encircle the two thigh portions 23 of the legs than is required to encircle the hip portion 48 just before the formation of the legs. This requirement for additional fabric is illustrated best in FIG. 3 wherein the lower panty portion 24 is formed in a single tubular arrangement while the two thigh portions 23 are formed as two separate tubular members. Thus, the amount of fabric required to form the two tubular members of the thigh portion exceeds the amount of fabric needed to form the single lower panty tubular portion. The ability to graduate stitches to increase diameter $d_2$ of blank 16 enables the provision of additional yarn and fabric to reduce yarn and fabric stress and provide more comfort to the wearer at such a critical location. The fabric loss shown reflected in the drawings is a result of the joining seam (used to join opposing slit edges of each blank 16 together) which starts in a yarn wale-wise or cross-course downwardly direction along one slit edge and then gradually departs through a transition zone where it continues around the end of the slit in a cross-wale direction until it then moves upwardly in a wale or cross-course direction. In the transition areas where the seam angularly extends over courses and wales, fabric is gradually removed so that a smaller diameter results in each of the blanks as fabric is removed. Longer stitches in the lower panty portion 24 results in more yarn and fabric being provided to offset the loss of the yarn and fabric removed to the seam sewing transition zones.

Upon completion of portion 24, a thigh graduation portion 26 is commenced and formed with a decreasing diameter $d_4$ After a sufficient length of the thigh portion is graduated, the knee portion 28 having a constant diameter $d_5$ is formed and terminates with the commencement of a lower leg graduation portion 30 having a decreasing diameter $d_6$. After portion 30 is completed, ankle portion 32 is formed with a constant diameter $d_7$. Blank 16 is completed by the formation of an instep graduation portion 34 having an increasing diameter $d_8$ and foot portion 36 with a constant diameter $d_9$.

The diameters of selectively positioned increasing and decreasing diameter portions $d_2$, $d_4$, $d_6$, and $d_8$ are changed gradually so that fabric density changes normally associated with abrupt graduation changes are avoided.

Embodiments of the present invention comprise a pantyhose garment shown 38, as shown in FIG. 2, formed by joining two blanks 16 like that described herein along edges 40 formed from slitting each blank 16 in a longitudinal direction and joining the two blanks 16 along those cut edges 40. Gusset 42 of a preselected size provides additional favorable fit and comfort characteristics to this embodiment. Other embodiments of the present invention comprise a pair of tubular blanks 16 sewn together without a gusset.

Pantyhose garment 38 includes a continuous welt 44, a tubular upper panty portion 46 and a panty graduation portion 48 of increasing diameter fashioned to cover that portion of the wearer's body which extends from the waist outwardly to the widest portion of the hips. Since the torso is generally uniform from the hips through the lower panty, or upper boot, portion 24, the diameter through the hips and lower panty portion 24 preferably remains constant. In the embodiment in FIG. 2, the balance of the garment in each leg is like that previously described for a single blank, decreasing in diameter through the thigh graduation portion 26, having a constant diameter through knee portion 28, decreasing in diameter through lower leg graduation portion 30, and having a constant diameter through ankle portion 32. Instep graduation portion 34 includes a decreasing diameter, and the garment terminates with a foot portion 36 of constant diameter.

In an embodiment of the present invention, a continuously knit, tubular pantyhose blank comprises panty, thigh, knee, ankle, and foot portions, each portion having a diameter; a constant number of wales throughout the blank, each wale having a stitch length; and a plurality of courses in each portion. A selected portion comprises an outwardly graduated diameter formed by increasing the stitch length in selected courses. Another selected portion comprises an inwardly graduated diameter formed by decreasing the stitch length in selected courses. As a result, the blank is configured to conform to the natural shape of a wearer's leg.

In preferred embodiments, the panty portion comprises an outwardly graduated diameter. Outward graduation of the panty portion can begin at any point during knitting after sufficient courses are knit in the blank to establish a predetermined panty cross-stretch diameter. By outwardly graduating courses at any point after a cross-stretch diameter is established, stitch length is increased and yarn and fabric is thereby added to those courses to relieve yarn and fabric stress at those selected points in the panty portion. Accordingly, the shape of a panty portion can be configured to provide a better fit and enhanced comfort and appearance at any point in a panty.

Figure 5:
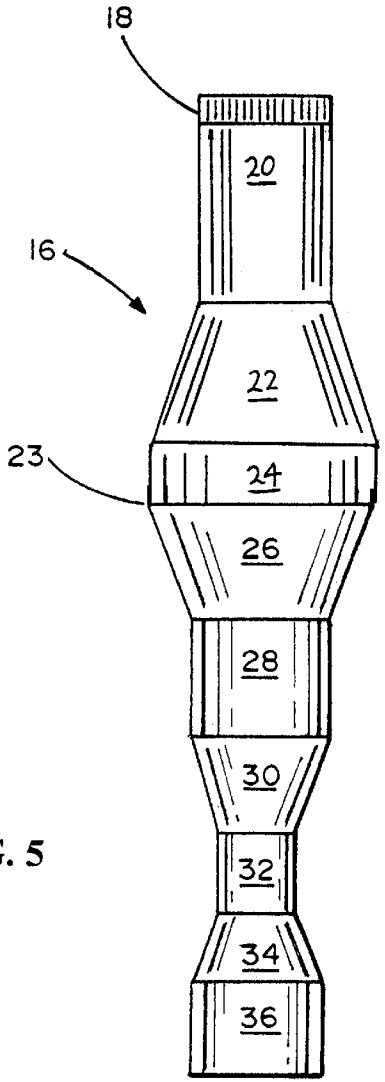
FIG. 5 is a frontal view of a hosiery blank comprising the invention, illustrating in emphasized fashion the selective inclusion of a plurality of graduation portions of increasing and decreasing diameter separating the panty, boot, knee, ankle, and foot portions, wherein outward graduation in the panty portion begins in the lower panty portion.
Figure 4:
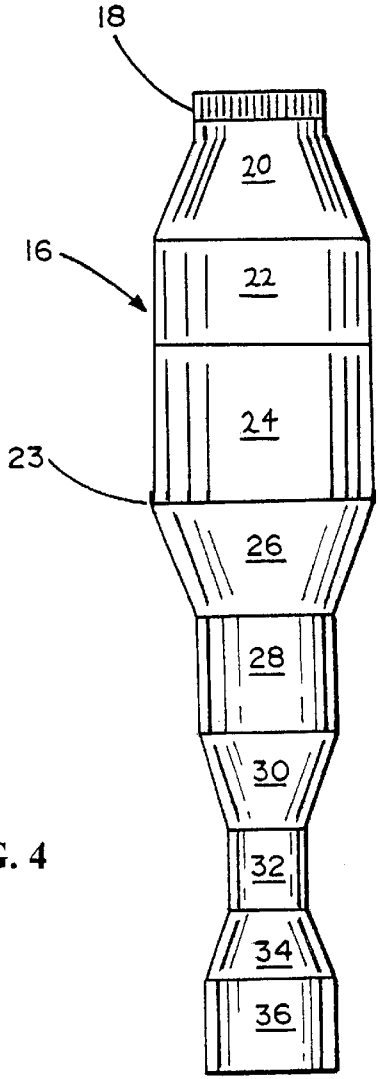
FIG. 4 is a frontal view of a hosiery blank comprising the invention, illustrating in emphasized fashion the selective inclusion of a plurality of graduation portions of increasing and decreasing diameter separating the panty, boot, knee, ankle, and foot portions, wherein outward graduation in the panty portion begins higher in the upper panty portion than in FIG. 1.

In particular embodiments, the panty portion further comprises an upper portion, a middle portion, and a lower portion. Outward graduation of the panty portion can begin in the upper panty portion, in the middle panty portion, and/or in the lower panty portion. Upper, middle, and lower panty portions are defined as relative ranges of a panty. For example, as shown in FIG. 1, upper panty portion 20 and lower panty portion 24 are connected by panty graduation portion 22, which can be considered a middle panty portion. Upper, middle, and lower panty portions are intended to include all courses knit in a panty. In some embodiments, the lower panty portion comprises a constant diameter. Preferably, outward graduation of the panty portion further comprises a gradual increase in the stitch length in downwardly successive courses. Referring to FIG. 4, as an example of outward graduation in a panty portion beginning in the upper panty portion 20, outward graduation begins much higher in the panty than in the embodiments in FIGS. 1 and 5, for example. Accordingly, a constant diameter in middle panty portion 22 and lower panty portion 24 is longer. In FIG. 4, outward graduation begins in a course as soon as a pre-determined panty cross-stretch diameter is established. Referring to FIG. 5, outward graduation begins lower in the panty than in the embodiments in FIGS. 1 and 4. Outward graduation begins in the middle panty portion 22, which results in a much longer constant diameter upper panty portion 20. In addition, the duration of outward graduation in FIG. 5 is relatively longer than in FIGS. 1 and 4, resulting in a much shorter constant diameter lower panty portion 24.

In embodiments of a continuously knit, tubular pantyhose blank of the present invention, each of the panty, thigh, knee, ankle, and foot portions comprises a different diameter. In addition, outwardly graduated portions and inwardly graduated portions can comprise different amounts of diameter graduation.

Embodiments of the present invention provide a pantyhose garment comprising a pair of continuously knit, tubular blanks of yarn, each blank comprising panty, thigh, knee, ankle, and foot portions, each portion having a diameter; a constant number of wales throughout each blank, each wale having a stitch length; and a plurality of courses in each portion. In such a pantyhose garment, a selected portion comprises an outwardly graduated diameter formed by increasing the stitch length in selected courses. In a preferred embodiment, the panty portion comprises an outwardly graduated diameter. Another selected portion comprises an inwardly graduated diameter formed by decreasing the stitch length in selected courses. A waist portion and a garment panty portion are formed from the pair of blanks slit along the panty portion of the blank and joined at the pairs of edges thus formed. Accordingly, the pantyhose garment is configured to conform to the natural shape of a wearer's lower body, including legs.

In addition to outward graduation in the panty portion, various embodiments of the present invention comprise outward graduation, inward graduation, and constant diameters in selected other portions of a pantyhose blank and/or garment. For example, the thigh portion can be inwardly graduated. A pantyhose blank can include a lower leg portion, which can be inwardly graduated. A pantyhose blank can include an instep portion connecting the ankle portion and the foot portion, wherein the instep portion is outwardly graduated. In particular embodiments, the knee portion, the ankle portion, and/or the foot portion comprise a constant diameter. Portions of a blank and/or garment are selected to have outward graduation, inward graduation, or constant diameters in various combinations depending on factors such as style, yarn s, and contours sought. Generally, selection of diameter and diameter graduation in particular portions of a blank and/or seeks to configured the blank and garment to conform to the natural shape of a wearer's lower body and leg.

In embodiments of the present invention, a pantyhose garment is formed without a gusset. Alternatively, embodiments of a pantyhose garment of the present invention include a gusset. Although addition of a gusset relieves some yarn and fabric stress in critical locations such as the panty and crotch areas, addition of yarn and fabric in those areas provided by graduated stitching as in the present invention permits even greater relief of such stress and enhances fit and comfort characteristics of a garment thus formed.

The present invention includes embodiments of a pantyhose garment that are footless. Other embodiments of the present invention include a body diameter garment, or a "body suit," in which anatomical contouring is important for desired fit, comfort, and appearance of the garment. Other embodiments comprise a continuously knit, pantyhose garment that is seamless. Other embodiments of the present invention comprise a pantyhose garment wherein the waist and panty portions are continuously knit, a pair of tubular blanks of yarn are continuously knit separately from the waist and panty portions, and the pantyhose garment is formed by sewing the pair of blanks to the panty portion. In such embodiments, a selected portion of the garment comprises an outwardly graduated diameter formed by increasing the stitch length in selected courses. Another selected portion comprises an inwardly graduated diameter formed by decreasing the stitch length in selected courses. As a result, the garment is configured to conform to the natural shape of a wearer's lower body and legs.

Embodiments of the present invention comprise a continuously knit panty garment comprising waist and panty portions, each portion having a diameter; a constant number of wales throughout the garment, each wale having a stitch length; and a plurality of courses in each portion. The panty portion comprises an outwardly graduated diameter formed by increasing the stitch length in selected courses to provide additional yarn to the selected courses. Outward graduation of the panty portion begins after sufficient courses are knit in the panty portion to establish a pre-determined panty cross-stretch diameter. In this manner, the panty garment is configured to conform to the natural shape of a wearer's pelvic area. The panty portion can further comprise an upper portion, a middle portion, and a lower portion, wherein outward graduation of the panty portion begins in the upper, middle, or lower panty portion, depending on style, size, and other manufacturing parameters. In one embodiment of such a panty garment, the panty garment further comprises a thigh portion, the lower panty portion comprises a constant diameter, and the thigh portion comprises an inwardly graduated diameter.

The present invention includes embodiments of a method of manufacturing a pantyhose garment, comprising continuously knitting a pair of tubular blanks of yarn, each blank comprising panty, thigh, knee, ankle, and foot portions, each portion having a diameter; a constant number of wales throughout each blank, each wale having a stitch length; and a plurality of courses in each portion. Such a method further comprises graduating outwardly the diameter of a selected portion or portions by increasing the stitch length to provide additional yarn to selected courses. The method also includes graduating inwardly the diameter of a selected portion or portions by decreasing the stitch length to remove yarn from selected courses. After the blanks are made, the pair of blanks are slit along the panty portion of the blank and joined at the pairs of edges thus formed to form a waist portion and a garment panty portion. In a preferred embodiment of such a method, the panty portion is outwardly graduated. In embodiments, graduating the diameter of the panty portion outwardly begins after sufficient courses are knit in the blank to establish a pre-determined panty cross-stretch diameter. As a result, the pantyhose garment is configured to conform to the natural shape of a wearer's lower body.

Embodiments of methods of the present invention include outwardly graduating, inwardly graduating, and holding diameters constant in selected other portions of a pantyhose blank and/or garment. For example, the thigh portion can be inwardly graduated. A pantyhose blank can include a lower leg portion, which can be inwardly graduated. A pantyhose blank can include an instep portion connecting the ankle portion and the foot portion, wherein the instep portion is outwardly graduated. In particular embodiments, the knee portion, the ankle portion, and/or the foot portion comprise a constant diameter. Selecting particular portions in a blank and/or garment for diameter graduation is intended to configured the blank and garment to conform to the natural shape of a wearer's lower body and leg.

Thus, embodiments of the invention provide a new construction for forming a hosiery blank and pantyhose made therefrom that includes technology resulting in a configuration that contours to the shape of the body for a superior fit, particularly in the lower panty portion, and along the entire length of the garment from the waist to the toe.

Although the present invention has been described with reference to particular embodiments, it should be recognized that these embodiments are merely illustrative of the principles of the present invention. Those of ordinary skill in the art will appreciate that continuously knit hosiery and underwear garments having variably graduated diameters of the present invention may be constructed and implemented in other ways and embodiments. Accordingly, the description herein should not be read as limiting the present invention, as other embodiments also fall within the scope of the present invention.

What is claimed is:

1. A continuously knit, tubular pantyhose blank comprising:

panty, thigh, knee, ankle, and foot portions, each portion having a diameter;

a constant number of wales throughout the blank, each wale having a stitch length;

a plurality of courses in each portion;

a first selected portion comprising an outwardly graduated diameter formed by increasing the stitch length in selected courses; and a second selected portion comprising an inwardly graduated diameter formed by decreasing the stitch length in selected courses;

wherein the first selected portion comprises the panty portion;

wherein the blank is configured to conform to the natural shape of a wearer's leg.

2. The blank of claim 1, wherein outward graduation of the panty portion begins after sufficient courses are knit in the blank to establish a pre-determined panty cross-stretch diameter.

3. The blank of claim 1, the panty portion further comprising an upper portion, a middle portion, and a lower portion, wherein outward graduation of the panty portion begins in the upper panty portion.

4. The blank of claim 1, the panty portion further comprising an upper portion, a middle portion, and a lower portion, wherein outward graduation of the panty portion begins in the middle panty portion.

5. The blank of claim 1, the panty portion further comprising an upper portion, a middle portion, and a lower portion, wherein outward graduation of the panty portion begins in the lower panty portion.

6. The blank of claim 3, wherein the lower panty portion comprises a constant diameter.

7. The blank of claim 1, wherein outward graduation of the panty portion further comprises a gradual increase in the stitch length in downwardly successive courses.

8. The blank of claim 1, wherein each of the panty, thigh, knee, ankle, and foot portions comprises a different diameter.

9. The blank of claim 1, wherein the first selected portion and the second selected portion further comprise different amounts of diameter graduation.

10. The blank of claim 1, wherein the second selected portion having an inwardly graduated diameter comprises the thigh portion.

11. The blank of claim 1, the blank further comprising a lower leg portion, wherein the knee portion comprises a constant diameter and the second selected portion having an inwardly graduated diameter comprises the lower leg portion.

12. The blank of claim 1, wherein the ankle portion comprises a constant diameter.

13. The blank of claim 1, wherein the foot portion comprises a constant diameter.

14. The blank of claim 1, the blank further comprising an instep portion connecting the ankle portion and the foot portion, wherein the first selected portion having an outwardly graduated diameter further comprises the instep portion.

15. The blank of claim 1, the blank further comprising a lower leg portion and an instep portion connecting the ankle portion and the foot portion, the panty portion further comprising an upper portion, a middle portion, and a lower portion, wherein outward graduation of the panty portion begins in the upper panty portion, wherein the lower panty portion comprises a constant diameter, wherein the second selected portion having an inwardly graduated diameter comprises the thigh portion, wherein the knee portion comprises a constant diameter, wherein the second selected portion having an inwardly graduated diameter further comprises the lower leg portion, wherein the ankle portion comprises a constant diameter, wherein the first selected portion having an outwardly graduated diameter further comprises the instep portion, and wherein the foot portion comprises a constant diameter.

16. A pantyhose garment comprising:

a pair of continuously knit, tubular blanks of yarn, each blank comprising panty, thigh, knee, ankle, and foot portions, each portion having a diameter;

a constant number of wales throughout each blank, each wale having a stitch length;

a plurality of courses in each portion;

a first selected portion comprising an outwardly graduated diameter formed by increasing the stitch length in selected courses to provide additional yarn to the selected courses;

a second selected portion comprising an inwardly graduated diameter formed by decreasing the stitch length in selected courses to remove yarn from the selected courses; and a waist portion and a garment panty portion formed from the pair of blanks slit along the panty portion of the blank and joined at the pairs of edges thus formed;

wherein the first selected portion comprises the panty portion;

wherein the pantyhose garment is configured to conform to the natural shape of a wearer's lower body.

17. The pantyhose garment of claim 16, wherein outward graduation of the panty portion begins after sufficient courses are knit in the blank to establish a pre-determined panty cross-stretch diameter.

18. The pantyhose garment of claim 16, the panty portion further comprising an upper portion, a middle portion, and a lower portion, wherein outward graduation of the panty portion begins in the upper panty portion.

19. The pantyhose garment of claim 16, the panty portion further comprising an upper portion, a middle portion, and a lower portion, wherein outward graduation of the panty portion begins in the middle panty portion.

20. The pantyhose garment of claim 16, the panty portion further comprising an upper portion, a middle portion, and a lower portion, wherein outward graduation of the panty portion begins in the lower panty portion.

21. The pantyhose garment of claim 18, wherein the lower panty portion comprises a constant diameter.

22. The pantyhose garment of claim 16, wherein outward graduation of the panty portion further comprises a gradual increase in the stitch length in downwardly successive courses.

23. The pantyhose garment of claim 16, wherein each of the panty, thigh, knee, ankle, and foot portions comprises a different diameter.

24. The pantyhose garment of claim 16, wherein the first selected portion and the second selected portion further comprise different amounts of diameter graduation.

25. The pantyhose garment of claim 16, wherein the second selected portion having an inwardly graduated diameter comprises the thigh portion.

26. The pantyhose garment of claim 16, the blank further comprising a lower leg portion, wherein the knee portion comprises a constant diameter and the second selected portion having an inwardly graduated diameter comprises the lower leg portion.

27. The pantyhose garment of claim 16, wherein the ankle portion comprises a constant diameter.

28. The pantyhose garment of claim 16, wherein the foot portion comprises a constant diameter.

29. The pantyhose garment of claim 16, the blank further comprising an instep portion connecting the ankle portion and the foot portion, wherein the first selected portion having an outwardly graduated diameter further comprises the instep portion.

30. The pantyhose garment of claim 19, the blank further comprising a lower leg portion and an instep portion connecting the ankle portion and the foot portion, the panty portion further comprising an upper portion, a middle portion, and a lower portion, wherein outward graduation of the panty portion begins in the upper panty portion, wherein the lower panty portion comprises a constant diameter, wherein the second selected portion having an inwardly graduated diameter comprises the thigh portion, wherein the knee portion comprises a constant diameter, wherein the second selected portion having an inwardly graduated diameter further comprises the lower leg portion, wherein the ankle portion comprises a constant diameter, wherein the first selected portion having an outwardly graduated diameter further comprises the instep portion, and wherein the foot portion comprises a constant diameter.

31. The pantyhose garment of claim 16, wherein the garment further comprises a gusset.

32. The pantyhose garment of claim 16, wherein the garment is footless.

33. The pantyhose garment of claim 16, wherein the garment comprises a body diameter garment.

34. A continuously knit, seamless pantyhose garment comprising:

waist, panty, thigh, knee, ankle, and foot portions, each portion having a diameter;

a constant number of wales throughout the garment, each wale having a stitch length;

a plurality of courses in each portion;

a first selected portion comprising an outwardly graduated diameter formed by increasing the stitch length in selected courses to provide additional yarn to the selected courses; and a second selected portion comprising an inwardly graduated diameter formed by decreasing the stitch length in selected courses to remove yarn from the selected courses;

wherein the first selected portion comprises the panty portion;

wherein the pantyhose garment is configured to conform to the natural shape of a wearer's lower body.

35. The pantyhose garment of claim 34, the garment further comprising a lower leg portion and an instep portion connecting the ankle portion and the foot portion, wherein the lower panty portion comprises a constant diameter, wherein the second selected portion having an inwardly graduated diameter comprises the thigh portion, wherein the knee portion comprises a constant diameter, wherein the second selected portion having an inwardly graduated diameter further comprises the lower leg portion, wherein the ankle portion comprises a constant diameter, wherein the first selected portion having an outwardly graduated diameter further comprises the instep portion, and wherein the foot portion comprises a constant diameter.

36. A pantyhose garment comprising:

continuously knit waist and panty portions;

a pair of tubular blanks of yarn, each blank continuously knit separately from the waist and panty portions, each blank comprising thigh, knee, ankle, and foot portions, the pantyhose garment formed by sewing the pair of blanks to the panty portion;

each waist, panty, and blank portion comprising a diameter;

a constant number of wales throughout each portion, each wale having a stitch length;

a plurality of courses in each portion;

a first selected portion comprising an outwardly graduated diameter formed by increasing the stitch length in selected courses to provide additional yarn to the selected courses; and a second selected portion comprising an inwardly graduated diameter formed by decreasing the stitch length in selected courses to remove yarn from the selected courses;

wherein the first selected portion comprises the panty portion;

wherein the pantyhose garment is configured to conform to the natural shape of a wearer's lower body and legs.

37. The pantyhose garment of claim 36, wherein outward graduation of the panty portion begins after sufficient courses are knit in the panty portion to establish a pre-determined panty cross-stretch diameter.

38. A continuously knit panty garment comprising:

waist and panty portions, each portion having a diameter;

a constant number of wales throughout the garment, each wale having a stitch length;

a plurality of courses in each portion; and the panty portion comprising an outwardly graduated diameter formed by increasing the stitch length in selected courses to provide additional yarn to the selected courses;

wherein outward graduation of the panty portion begins after sufficient courses are knit in the panty portion to establish a pre-determined panty cross-stretch diameter; and wherein the panty garment is configured to conform to the natural shape of a wearer's pelvic area.

39. The panty garment of claim 38, the panty portion further comprising an upper portion, a middle portion, and a lower portion, wherein outward graduation of the panty portion begins in the upper panty portion.

40. The panty garment of claim 38, the panty portion further comprising an upper portion, a middle portion, and a lower portion, wherein outward graduation of the panty portion begins in the middle panty portion.

41. The panty garment of claim 38, the panty portion further comprising an upper portion, a middle portion, and a lower portion, wherein outward graduation of the panty portion begins in the lower panty portion.

42. The panty garment of claim 38, wherein the lower panty portion comprises a constant diameter.

43. The panty garment of claim 38, further comprising a thigh portion, wherein the thigh portion comprises an inwardly graduated diameter formed by decreasing the stitch length in selected courses to remove yarn from the selected courses.

44. A method of manufacturing a pantyhose garment, comprising:

continuously knitting a pair of tubular blanks of yarn, each blank comprising panty, thigh, knee, ankle, and foot portions, each portion having a diameter; a constant number of wales throughout each blank, each wale having a stitch length; and a plurality of courses in each portion;

graduating outwardly the diameter of a first selected portion by increasing the stitch length to provide additional yarn to selected courses;

graduating inwardly the diameter of a second selected portion by decreasing the stitch length to remove yarn from selected courses; and slitting the pair of blanks along the panty portion of the blank and joining the blanks at the pairs of edges thus formed to form a waist portion and a garment panty portion;

wherein the first selected portion comprises the panty portion;

wherein the pantyhose garment is configured to conform to the natural shape of a wearer's lower body.

45. The method of claim 44, wherein graduating the diameter of the panty portion outwardly begins after sufficient courses are knit in the blank to establish a predetermined panty cross-stretch diameter.

46. The method of claim 44, the blank further comprising a lower leg portion and an instep portion connecting the ankle portion and the foot portion, the panty portion further comprising an upper portion, a middle portion, and a lower portion, wherein graduating the diameter of the panty portion outwardly begins in the upper panty portion, wherein the lower panty portion comprises a constant diameter, wherein the second selected portion having an inwardly graduated diameter comprises the thigh portion, wherein the knee portion comprises a constant diameter, wherein the second selected portion having an inwardly graduated diameter further comprises the lower leg portion, wherein the ankle portion comprises a constant diameter, wherein the first selected portion having an outwardly graduated diameter further comprises the instep portion, and wherein the foot portion comprises a constant diameter.

* * * * *

UNITED STATES PATENT AND TRADEMARK OFFICE

CERTIFICATE OF CORRECTION

PATENT NO. : 6,502,430 B1
DATED : January 7, 2003
INVENTOR(S) : Jonathan Myers

It is certified that error appears in the above-identified patent and that said Letters Patent is hereby corrected as shown below:

Title page,
Item [56], References Cited, U.S. PATENT DOCUMENTS, insert

| | | |
|---|---|---|
| -- 402,202 | 04-30-89 | Sutton, S. T. |
| 2,216,062 | 09-24-40 | Williams, Harold E. |
| 2,301,065 | 11-03-42 | Mills, R. K. |
| 2,474,894 | 07-05-49 | Gottschalck, Lawrence W. |
| 2,948,132 | 08-09-60 | Gift, John |
| 3,068,675 | 12-18-62 | Payne, Jr., W. M. |
| 3,595,034 | 07-27-71 | Safrit, Sam C. |
| 3,757,354 | 09-11-73 | Moody, Robert J. |
| 3,763,668 | 10-09-73 | Williams, Charlie L. |
| 4,502,301 | 03-05-85 | Swallow, Roger T. et al. |
| 5,016,449 | 05-21-91 | Negri, Ettore |
| 5,511,394 | 04-30-96 | Shima, Masahiro |
| 5,442,564 | 08-15-95 | Merlini, Marco et al. |
| 5,606,875 | 03-04-97 | Nishitani, Hirokazu et al. -- |

Signed and Sealed this

Fifteenth Day of July, 2003

JAMES E. ROGAN
*Director of the United States Patent and Trademark Office*